United States Patent [19]

Ward

[11] 4,100,697

[45] Jul. 18, 1978

[54] HOOP TOY

[76] Inventor: Daniel Ward, 541 Vanessa Crescent, Mississauga, Ontario, Canada, L5H 2N4

[21] Appl. No.: 717,023

[22] Filed: Aug. 24, 1976

[51] Int. Cl.[2] ..... A63H 33/26

[52] U.S. Cl. ..... 46/269; 46/52; 46/114; 46/220

[58] Field of Search ..... 46/114, 220, 111, 112, 46/205, 210, 52, 63, 248, 253, 269, 1 G

[56] References Cited

U.S. PATENT DOCUMENTS

| | | | |
|---|---|---|---|
| 2,928,206 | 3/1960 | Kuhn | 46/51 |
| 2,936,386 | 5/1960 | Cohn | 46/253 |
| 3,523,387 | 8/1970 | Smith | 46/52 |
| 3,545,126 | 12/1970 | Brown | 46/269 |
| 3,823,507 | 7/1974 | Berner | 46/220 |

*Primary Examiner*—Louis G. Mancene
*Assistant Examiner*—Mickey Yu
*Attorney, Agent, or Firm*—Robert D. Farkas

[57] ABSTRACT

This disclosure pertains to a circular lightweight hoop having a hollow circular cross-section, to which is removably attached a flexible wire-like element. One end of the wire-like element is removably fitted to a shaft and thence through a clutch to an output shaft of a motor contained within a portable hand-held housing also containing an operating switch and a battery. The hoop contains a pair of ports fluidly communicating atmospheric air to an otherwise sealed compartment contained within the hoop. A flap panel adjacent one of the ports, directs air into the compartment and out of the remaining port, creating a whistling sound upon the hoop being rotated by the operation of the motor.

6 Claims, 3 Drawing Figures

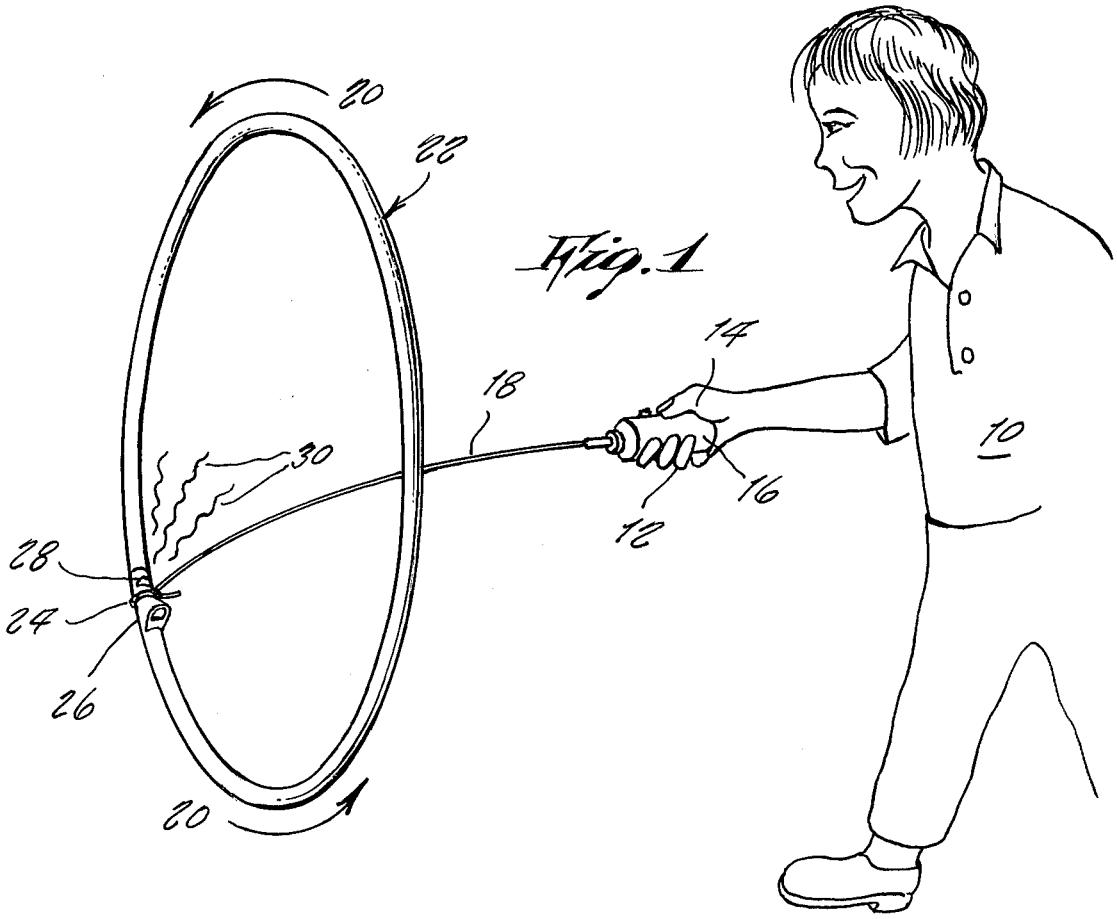
Fig. 1
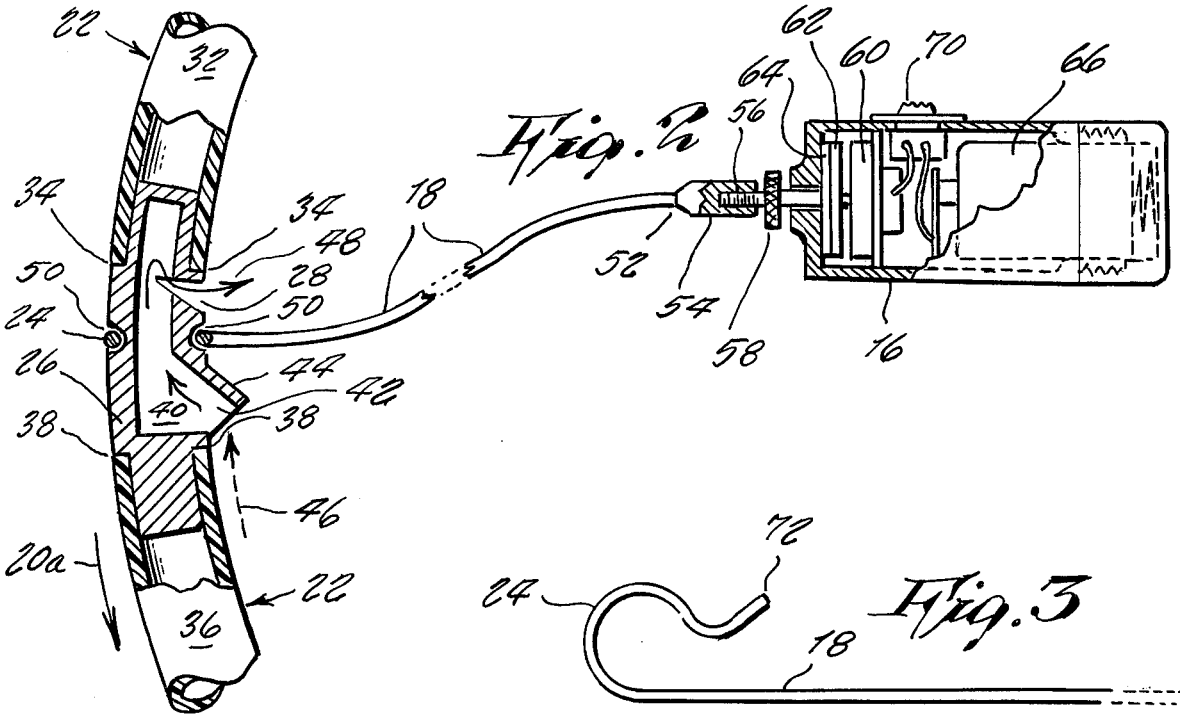
Fig. 2
Fig. 3

HOOP TOY

BACKGROUND OF THE INVENTION

1. The Field of the Invention

This invention relates to toys and more particularly to that class of hoop toys rotated in lariat fashion utilizing a flexible element therefor.

2. Description of the Prior Art

The prior art abounds with rope spinning hoops. U.S. Pat. No. 2,071,041 issued on Feb. 16, 1937 to A. F. Maggio teaches a circular hoop having a circumferential notch in its outermost periphery. A rope-like element passes through an opening in the hoop and into the center of the notch terminated in a knot. The other end of the rope-like element passes through an elongated hole in a handle, and is similarly terminated in a knot. Partially wrapping a portion of the length of the rope-like element adjacent the knotted end furthest from the handle, enables the user to twirl the hoop initially, followed by maintaining the hoop in twirling lariat fashion by imparting a small circular motion to the handle, having the other end of the rope-like element rotating in the elongated hole therewithin.

U.S. Pat. No. 2,039,731 issued on May 5, 1936 to C. Martin discloses a toy utilizing a rigid circular hoop and having one end of a rope-like element secured within a confined region of the periphery of the hoop. The other end of the rope-like element is fixedly secured to a rod, about which a handle is journalled. The Martin toy must be operated manually and started without benefit of the tangential starting forces utilized in the Maggio disclosure.

U.S. Pat. No. 3,528,194 issued on Sept. 15, 1970 to E. Motluk teaches an article of amusement comprising a rigid hoop to which is fastened a flexible cord enabling a person to hold on to one end and twirl the hoop. The cord is attached to the hoop in such a manner such that the hoop can revolve on an axis tangential to the hoop at the locus of attachment, but the hoop cannot move circumferentially to the cord at the locus of attachment. A handle is provided at the end of the cord which enables the hoop to be twirled without twisting the cord.

All of the aforementioned Patents suffer the common deficiency of having one end of the cord, rope, or otherwise described flexible element, fixedly secured to the hoop, thereby precluding the use of the hoop in conventional hoop rolling play. Furthermore, rotation of the hoop provides only visual amusement and must be accompanied by a strenuous continued physical effort to maintain the hoop revolving.

SUMMARY OF THE INVENTION

A primary object of the present invention is to provide a hoop which may be detachably engaged to a hoop rotating flexible element.

Another object of the present invention is to provide a hoop, which when rotated in a given direction at sufficient speeds, creates an audible tone.

Still another object of the present invention is to provide a motorized hoop rotating apparatus adapted to rotate a hoop flexibly attached thereto.

Yet another object of the present invention is to provide an apparatus which is inexpensively manufactured.

Lariat twirling is an art usually beyond the learning capabilities of children and presents a substantial challenge to adults. Stiffened circular sections are often employed as a means of enabling a novice to start the loop of the lariat in its rotational activity with some degree of ease. The instant invention provides a stiffened loop in the form of a hoop rotatably attached to a handle. The hoop may be detached from the flexible inter-connecting element enabling the hoop to be utilized in throwing, rolling or twisting about the body of the user in conventional fashion. The handle of the apparatus includes a motor and a clutch. The outermost clutch element is fixedly secured to the proximal end of the flexible joining element. The motor is operated by batteries included in the handle housing by utilizing an on-off motor switch. When the motor is energized, The clutch faces engage causing the hoop to rotate at a high speed. At other times, the hoop may be rotated by grasping the distal end of the flexible element with the fingers and rotating the handle in a semi-circle.

The hoop contains a closed compartment having two orifices communicating from the compartment to the atmosphere, thus creating a whistle which emits a tone upon the passage of air into and out of the compartment. Since the intensity of the tone is a function of the speed of rotation of the hoop, the user's skill in the judicious use of the motor or of manually applied forces to the handle becomes part of the enjoyment of the apparatus when being utilized as a lariat.

These objects as well as other objects of the present invention will become more readily apparent after reading the following description of the accompanying drawings.

BRIEF DESCRIPTION OF THE DRAWINGS

FIG. 1 is a perspective view of the instant invention shown being operated by a user.

FIG. 2 is a partial perspective view of the instnat invention showing a portion of the hoop and the handle in cross-section.

FIG. 3 is a side elevation view of the distal end of the flexible element.

DESCRIPTION OF THE PREFERRED EMBODIMENT

The structure and method of fabrication of the present invention is applicable to a hoop formed from hollow circular cross-sectional tubing bent so as to form a virtually closed hoop-like shape. A connecting device fits within opposed open ends of the formed tubing so as to create thereby a completely circular hoop. The joining device is adapted with a closed compartment intermediate the ends thereof. Two orifices pierce the surface of the joining device intermediate the ends of the tubing. One of the orifices is provided with an air directing plate affixed at an acute angle to the surface of the joining device, adjacent the orifice. Air passing along the periphery of the tube and the joining device is captured by the plate and directed through the orifice adjacent thereto into the interior compartment. The air leaving the compartment creates a whistling tone upon its passage through the other orifice. A circumferential notch is formed on the exterior surface of the joining device and is utilized to engage a hook-like end of a spring steel wire therein. The other end of the spring steel wire is connected to a shaft, coupled to one plate of a clutch, contained within a housing. The other end of the clutch is rotatably joined to an output shaft of a motor, similarly contained within the handle housing. When the motor is energized, by utilizing an operating switch and a battery, similarly contained within the housing, the other plate of the clutch is thrust towards and engages the outermost clutch plate, thereby causing the rotation of the spring steel wire and the hoop removably joined thereto. The distal end of the spring steel wire is removably joined to the outermost clutch plate as is a knurled surface, enabling the user to prevent the rotation of the proximal end of the spring steel wire by the grasping action of the fingers of the user thereon.

Now referring to the Figures, and more particularly to the embodiment illustrated in FIG. 1 showing a user 10 utilizing his fingers 12 and thumb 14 to grasp housing 16. Spring steel wire 18 may rotate in the direction of arrows 20 relative to the fixed position of handle 16. Hoop 22 is removably connected to end 24 of spring steel wire 18 at joining device 26. Sound tones emanate from orifice 28 and are denoted by wavey lines 30 upon the rotation of the hoop in the direction of arrows 20.

FIG. 2 illustrates hollow tubular portion 32 of hoop 22 having edges 34 at the end thereof. Another hollow tubular portion 36 of hoop 22 having edges 38 at the end thereof oppose edges 34 and are joined by joining element 26. Closed compartment 40 resides within joining device 26 and is fluidly communicated to the exterior surfaces thereof by orifices 28 and 42. Plate 44 directs air, shown by dotted lines 46 into the interior of compartment 40 when hoop 22 is rotated in the direction of arrow 20*a*. Arrow 48 illustrates the emergence of the air through orifice 28, which creates the whistling tone. Circumferential notch 50 captures end 24 of spring steel wire 18. The other end 52 of spring steel wire 18 terminates in an internally threaded fitting 54 threadingly engaging shaft 56. Threaded surface 58 frictionally clamps against fitting 54 and may be utilized, for grasping purposes, by the user to prevent the rotation of shaft 56 relative to housing 16. Motor 60 rotationally operates clutch plate 62 when energized. Clutch plate 64 is fixedly secured to shaft 56. When motor 60 is energized, clutch plate 62 is thrust in the direction of clutch plate 64 and engages therewith, utilizing thrust clutch manufacturing techniques. Battery 66 is shown included within housing 16 as is switch 68. Switch operating lever 70, passing through an opening in housing 16, controls the operation of switch 68 which is in a series circuit with battery 66 and motor 60.

FIG. 3 illustrates end 24 of spring steel wire 18 shown formed into a hook-like shape having a partially circular area confined within the open portions thereof. End 72 is directed outwardly from the contained partial circular area to facilitate installation and removal of end 24 into and from circular notch 50, as shown in FIG. 2.

One of the advantage of the present invention is a hoop which may be detachably engaged to a hoop rotating element.

Another advantage of the present invention is a hoop, which when rotated in a given direction at sufficient speeds creates an audible tone.

Still another advantage of the present invention is a motorized hoop rotating apparatus adapted to rotate a hoop flexible attached thereto.

Yet another advantage of the present invention is an apparatus which is inexpensive to manufacture.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appended claims.

I claim:

1. A hoop toy comprising a length of hollow tubing, a joining device, said joining device having the ends of said length of hollow tubing fixedly secured thereto forming a hoop, a handle, said handle forming a housing, a shaft, said housing containing a motor and power supply means therewithin, a flexible wire-like element, one end of said wire-like element removably secured to said joining device, the other end of said wire-like element removably secured to said shaft, said shaft passing through an opening in said housing, said shaft being rotated by said motor when said motor is being energized by said power supply means, tone generating means for generating an audible tone upon the rotation of said hoop about a line, said line passing through a plane engaging the outermost surface of said hoop, wherein said tone generating means includes a compartment, said compartment being disposed within said joining device, a pair of orifices being disposed in the walls of said joining device and fluidly communicating to said compartment, a plate, said plate being fixedly secured to the surface of said joining device adjacent one of said pair of orifices, the other of said pair of orifices creating a whistling tone upon the ingress of moving air through said one of said pair of orifices and the egress of said moving air through said other of said pair of orifices.

2. The hoop toy as claimed in claim 1 further comprising an annular notch disposed about the circumference of said joining device, a hook-like curvature of said wire-like element being disposed at said one end thereof, said hook-like curvature for removable frictional engagement within said annular notch.

3. The hoop toy as claimed in claim 1 further comprising a clutch, one plate of said clutch fixedly secured to said shaft, the other plate of said clutch fixedly secured to an output shaft of said motor, said other plate being urged into frictional contact with said one plate upon said motor being energized, said clutch being contained within said housing.

4. The hoop toy as comprised in claim 1 further comprising said shaft having a portion thereof provided with a knurled surface, said knurled surface being coaxially aligned with the longitudinal axis of said shaft and being disposed external to said housing.

5. The hoop toy as claimed in claim 1 wherein said shaft is provided with external threads on the external surface thereof, a fitting fixedly secured to said other end of said wire-like element, said fitting having a hole therein co-axially aligned with said other end of said wire-like element, said hole having complementary threads to said external threads.

6. The hoop toy as claimed in claim 1 wherein said power supply means comprises a battery, a switch, said battery in a series circuit with the terminals of said switch and said motor.

* * * * *